US009550359B2

(12) United States Patent
O'Reilly et al.

(10) Patent No.: US 9,550,359 B2
(45) Date of Patent: Jan. 24, 2017

(54) INKJET NOZZLE DEVICE WITH ROOF ACTUATOR CONNECTED TO LATERAL DRIVE CIRCUITRY

(71) Applicant: Memjet Technology Limited, Dublin (IE)

(72) Inventors: Ronan Padraig Sean O'Reilly, Dublin (IE); Gregory John McAvoy, Dublin (IE); Emma Rose Kerr, Dublin (IE); Vincent Patrick Lawlor, Dublin (IE); Misty Bagnat, Dublin (IE); Brian Kevin Donohoe, Dublin (IE); Eimear Ryan, Dublin (IE)

(73) Assignee: Memjet Technology Limited (IE)

( * ) Notice: Subject to any disclaimer, the term of this patent is extended or adjusted under 35 U.S.C. 154(b) by 0 days.

(21) Appl. No.: 14/843,208

(22) Filed: Sep. 2, 2015

(65) Prior Publication Data

US 2016/0075135 A1 Mar. 17, 2016

Related U.S. Application Data

(60) Provisional application No. 62/051,625, filed on Sep. 17, 2014.

(51) Int. Cl.
*B41J 2/14* (2006.01)
*B41J 2/16* (2006.01)

(52) U.S. Cl.
CPC ..... *B41J 2/1433* (2013.01); *B41J 2/14016* (2013.01); *B41J 2/14201* (2013.01); (Continued)

(58) Field of Classification Search
CPC ..... B41J 2/1433; B41J 2/14072; B41J 2/1601; B41J 2/1607; B41J 2/14201; B41J 2/1648; B41J 2/14016; B41J 2/1628; B41J 2/14427; B41J 2/1642; B41J 2002/1437; B41J 2002/18; B41J 2002/13
(Continued)

(56) References Cited

U.S. PATENT DOCUMENTS 6,260,953 B1 7/2001 Silverbrook
7,819,509 B2 * 10/2010 Mita ..... B41J 2/14233 347/71
(Continued)

FOREIGN PATENT DOCUMENTS

EP 1 116 588 A1 7/2001
JP 2000 289201 A 10/2000
(Continued)

OTHER PUBLICATIONS

ISR and Written Opinion mailed Nov. 20, 2015.

*Primary Examiner* — Julian Huffman
*Assistant Examiner* — Michael Konczal
(74) *Attorney, Agent, or Firm* — Cooley LLP

(57) ABSTRACT

An inkjet printhead integrated circuit includes: a substrate having a silicon layer; a nozzle plate disposed on the silicon layer; and embedded inkjet nozzle devices. Each inkjet nozzle device includes a nozzle chamber having a roof actuator; drive circuitry laterally disposed relative to the nozzle chamber; a connection arm extending parallel with the nozzle plate from the actuator towards the drive circuitry; and a metal via interconnecting each connection arm and the drive circuitry, the metal via extending perpendicularly to the nozzle plate. The drive circuitry is positioned proximal the nozzle plate relative to a plane of the floor.

9 Claims, 1 Drawing Sheet

(52) U.S. Cl.
CPC ..... *B41J 2/14427* (2013.01); *B41J 2/1601* (2013.01); *B41J 2/1607* (2013.01); *B41J 2/1628* (2013.01); *B41J 2/1642* (2013.01); *B41J 2/1648* (2013.01); *B41J 2002/1437* (2013.01); *B41J 2002/14435* (2013.01); *B41J 2202/13* (2013.01); *B41J 2202/18* (2013.01)

(58) Field of Classification Search
USPC ..... 347/47
See application file for complete search history.

(56) References Cited

U.S. PATENT DOCUMENTS

| | | | | |
|---|---|---|---|---|
| 8,079,668 | B2 * | 12/2011 | McAvoy | B41J 2/14427 347/54 |
| 8,991,954 | B2 * | 3/2015 | Govyadinov | B41J 2/14233 347/44 |
| 2007/0064037 | A1 | 3/2007 | Hawkins | |
| 2014/0063095 | A1 | 3/2014 | Yokoyama | |

FOREIGN PATENT DOCUMENTS

| | | | | |
|---|---|---|---|---|
| JP | 2001 205808 | A | | 7/2001 |
| JP | 2001205808 | A | * | 7/2001 |

* cited by examiner

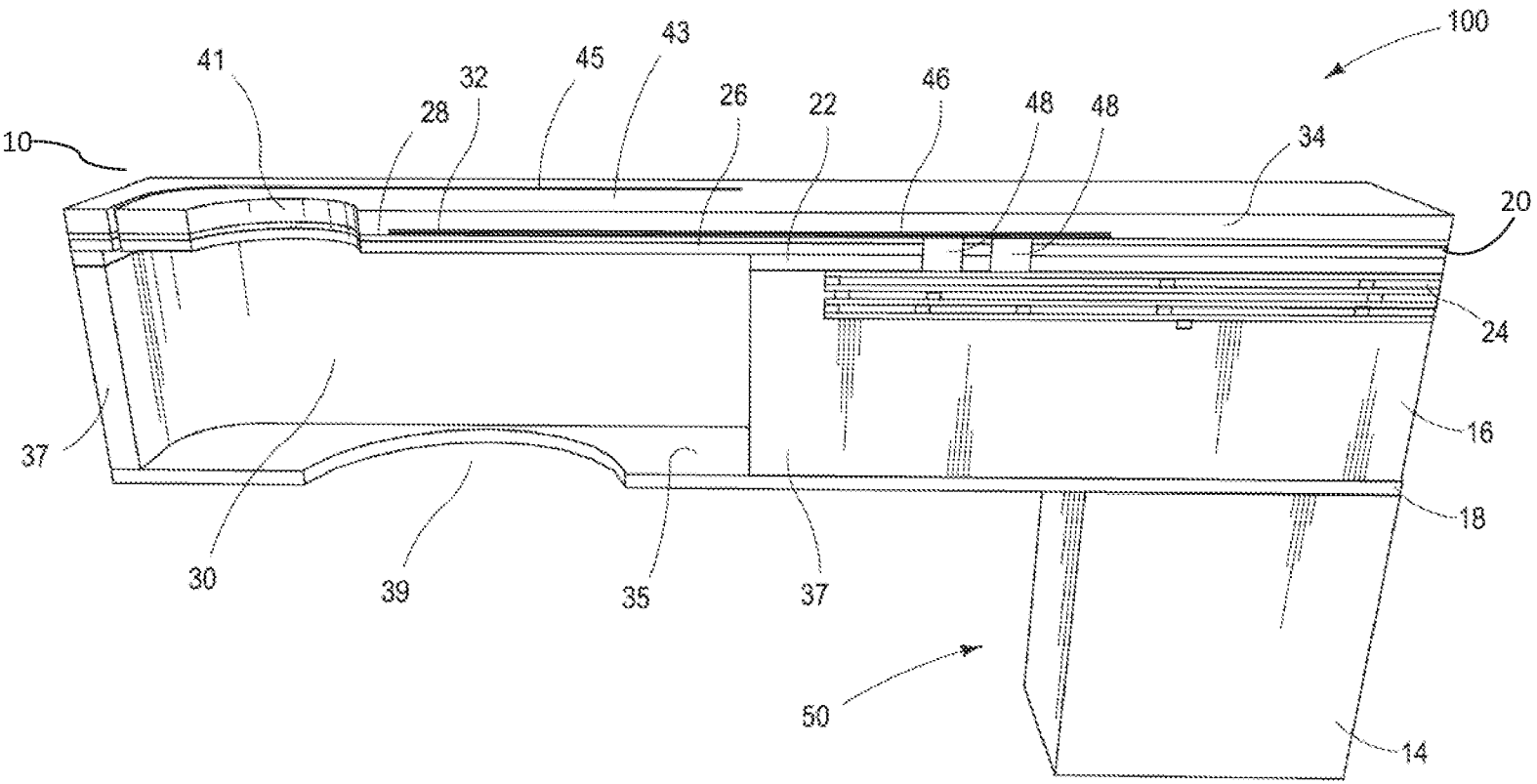
100
20
24
16
18
14
34
48
48
46
22
26
43
45
32
28
41
10
37
30
39
35
37
50

INKJET NOZZLE DEVICE WITH ROOF ACTUATOR CONNECTED TO LATERAL DRIVE CIRCUITRY

FIELD OF THE INVENTION

This invention relates to printhead integrated circuits comprising inkjet nozzle devices. It has been developed primarily for producing robust, low-cost printheads having efficient current transfer from drive circuitry to MEMS actuators

BACKGROUND OF THE INVENTION

The Applicant has developed a range of Memjet® inkjet printers as described in, for example, WO2011/143700, WO2011/143699 and WO2009/089567, the contents of which are herein incorporated by reference. Memjet® printers employ a stationary pagewidth printhead in combination with a feed mechanism which feeds print media past the printhead in a single pass. Memjet® printers therefore provide much higher printing speeds than conventional scanning inkjet printers.

An inkjet printhead is comprised of a plurality (typically thousands) of individual inkjet nozzle devices, each supplied with ink. Each inkjet nozzle device typically comprises a nozzle chamber having a nozzle aperture and an actuator for ejecting ink through the nozzle aperture. The design space for inkjet nozzle devices is vast and a plethora of different nozzle devices have been described in the patent literature, including different types of actuators and different device configurations.

Most current inkjet printheads comprise one or more MEMS printhead integrated circuits, whereby inkjet nozzle devices are fabricated on a CMOS silicon wafer using MEMS fabrication techniques. Integration of MEMS and CMOS features is a crucial aspect of MEMS printhead design.

Research Disclosure 596074 and U.S. Pat. No. 6,938,340 describe inkjet nozzle devices comprising a MEMS layer disposed on a silicon-on-insulator substrate. The insulator layer facilitates control of backside ink channel etch processes.

Some types of inkjet nozzle devices employ an actuator bonded to the roof of a nozzle chamber. For example, U.S. Pat. No. 7,654,645 describes thermal bubble-forming actuators bonded to the roof of the nozzle chamber; U.S. Pat. No. 5,812,162 describes thermal actuators bonded to the roof of the nozzle chamber, which warm ink to reduce surface tension and cause droplet ejection; U.S. Pat. No. 7,819,503 describes nozzle chambers having a moving roof portion comprising a thermoelastic bend actuator; and U.S. Pat. No. 5,828,394 describes a nozzle chamber having a moving roof portion comprising piezoelectric actuator.

Roof-bonded actuators present different design challenges compared to more usual floor-bonded actuators. This is because MEMS-CMOS integration must deliver power efficiently from drive transistors in the CMOS layer up to the actuators in the MEMS layer, inevitably using electrical connectors which extend over a height of the nozzle chamber. This, in turn, places practical limitations on nozzle chamber heights.

U.S. Pat. No. 7,794,056 and U.S. Pat. No. 7,819,503 describe two different types of electrical connectors for delivering current to a thermoelastic actuator positioned in a moving portion of a nozzle chamber roof.

It would be desirable to provide a printhead have excellent nozzle plate robustness. It would further be desirable to provide an improved fabrication process for integrating MEMS and CMOS features. It would further be desirable to provide inkjet nozzle devices having roof actuators with excellent electrical efficiency and, particularly, power transfer from drive circuitry which is independent of nozzle chamber height.

SUMMARY OF THE INVENTION

In accordance with a first aspect of the present invention, there is provided an inkjet printhead integrated circuit comprising:

a silicon-on-insulator substrate having a first layer of silicon, an insulator layer disposed on the first layer of silicon and a second layer of silicon disposed on the insulator layer;

a nozzle plate disposed on the second layer of silicon; and one or more embedded inkjet nozzle devices, each inkjet nozzle device comprising:

a nozzle chamber defined in the second layer of silicon, each nozzle chamber comprising: a roof defining a respective nozzle opening, the roof comprising part of the nozzle plate; a floor comprising part of the insulator layer; and sidewalls extending from the floor to the roof, the second layer of silicon defining the sidewalls;

an actuator for ejecting ink through the nozzle opening; and drive circuitry connected to the actuator.

Printhead integrated circuits ("printhead chips") according to the first aspect advantageously make use of silicon-on-insulator (SOI) wafers so as to provide novel, embedded inkjet nozzle devices. Conventional MEMS fabrication processes build up MEMS structures on a passivated CMOS layer. In the conventional process, MEMS structures are built up by a series of deposition, masking and etching steps, with the height of ink chambers being defined by the height of one of the deposited layers. For example, in some commercial printers, ink chambers are defined in a deposited polymeric layer (e.g. SU8); in other commercial printers, ink chambers are constructed from a deposited ceramic material (e.g. silicon nitride or silicon oxide). Inevitably, the conventional MEMS fabrication techniques introduce potential problems such as planarity, robustness, limitations on nozzle chamber heights, power transfer from drive circuitry etc.

By contrast, the printhead integrated circuits according to the first aspect ameliorate at least some of these problems and offer a novel approach to MEMS printhead design and fabrication. With a nozzle plate deposited directly on an SOI wafer, potential problems of nozzle plate planarity are, to a large extent, avoided. With a planar nozzle plate and inkjet devices embedded in the subjacent silicon layer, the printheads have greater mechanical robustness than conventional MEMS printheads. With the nozzle chamber defined in a frontside silicon layer of an SOI wafer, there are fewer limitations on the maximum chamber height achievable from conventional MEMS deposition processes. Furthermore, electrical connections to CMOS drive circuitry, typically laterally disposed relative to each nozzle chamber, are simplified. These and other advantages of the present invention will be readily apparent from the detailed description hereinbelow.

Preferably, the first layer of silicon is relatively thicker than the second layer of silicon. The second layer of silicon may have a thickness in the range of 5 to 50 microns, while the first layer of silicon is bulk silicon which may have a thickness in the range of 100 to 1000 microns. The separating insulator layer is typically comprised of silicon dioxide, as known in the art, and has a thickness in the range of 1 to 10 microns. CMOS circuitry is integrated into the second layer during SOI wafer production.

Preferably, a height of each nozzle chamber corresponds to a thickness of the second layer of silicon. The nozzle chamber is generally defined by etching the second layer down to the insulator layer, which acts as an etch stop for a frontside chamber etch.

Preferably, a chamber inlet is defined in the floor of each nozzle chamber. The chamber inlet may be defined by a frontside or backside etch of the insulator layer, depending on the particular sequence of MEMS fabrication steps employed.

Preferably, the roof comprises the actuator. The roof actuator may be, for example, a thermal bubble-forming resistive heater element (see, for example, U.S. Pat. No. 7,654,645); a surface tension-reducing heater element (see, for example U.S. Pat. No. 5,812,162); a thermoelastic bend actuator (see, for example, U.S. Pat. No. 7,819,503) or a piezoelectric transducer (see, for example, U.S. Pat. No. 5,828,394).

Depending on the type of actuator employed, it may be bonded to a lower surface or an upper surface of the roof, or sandwiched between different layers within the roof. For example, a thermal bend actuator may comprising a thermoelastic element bonded to an upper surface of a passive element so as to provide a moving roof portion, which bends towards the floor of the nozzle chamber upon actuation. On the other hand, a resistive heater element may be bonded to a lower surface of the roof so as to maximize thermal contact with ink inside the nozzle chamber.

The roof comprises part of the nozzle plate, which may be comprised of one or more different layers. For example, the nozzle plate may comprise a monolayer of silicon oxide or a monolayer of silicon nitride. Alternatively, the nozzle plate may be bi-layered comprising a layer of silicon oxide and a layer of silicon nitride. Further nozzle plate layers are also within the ambit of the present invention. In some embodiments, the nozzle plate may comprise a coating, for example, to facilitate efficient printhead maintenance or cover any exposed actuators to prevent electrical shorting via ink across the nozzle plate. The coating may comprise, for example, a polymer coating, such as polydimethylsilicone (PDMS), a polysilsesquioxane (PSQ), an epoxy-based photoresist (e.g. SU-8) etc. Alternatively, the coating may comprise a low-k dielectric material.

Preferably, the drive circuitry is laterally disposed relative to the nozzle chamber; that is, at one side of one of the sidewalls. The drive circuitry is typically CMOS circuitry comprising a plurality of metal layers (e.g. 2 to 4 layers) separated from each by interlayer dielectric (ILD) layers.

Preferably, the drive circuitry is positioned proximal the nozzle plate relative to the insulator layer of the SOI substrate and/or a plane containing the floor of the nozzle chamber. This arrangement contrasts with conventional inkjet nozzle devices, where the drive circuitry is usually positioned distal from the nozzle plate relative to a plane containing the floor of the nozzle chamber.

Preferably, each inkjet nozzle device further comprises one or more connection arms extending parallel with the nozzle plate, each connection arm extending from the actuator towards the drive circuitry. Preferably, the actuator and connections arms are coplanar and comprised of a same material by virtue of a co-deposition process.

Preferably, each inkjet nozzle device further comprises at least one metal via interconnecting each connection arm and the drive circuitry, each metal via extending perpendicularly to the nozzle plate. The metal via is typically comprised of copper and may be formed using a damascene-like process. Preferably, a height of the metal vias is less than a height of the nozzle chamber. Since the lengths of the electrical connections to drive circuitry is independent of the height of the nozzle chamber, excellent electrical efficiency and power transfer can be achieved by minimizing the length of the current path.

Preferably, at least one ink feed channel is defined in the first layer of silicon. Preferably, the inkjet nozzle devices are arranged in rows, wherein one or more rows of the inkjet nozzle devices receive ink from a common ink feed channel via respective chamber inlets. For example, one common ink feed channel may supply ink to a pair of nozzle rows in a multi-color printhead. Alternatively, one common ink feed channel may supply ink to multiple nozzle rows in a monochrome printhead.

In accordance with a second aspect, there is provided an inkjet printhead integrated circuit comprising:

a substrate having at least one silicon layer;

a nozzle plate disposed on the silicon layer; and one or more embedded inkjet nozzle devices, each inkjet nozzle device comprising:

a nozzle chamber defined in the silicon layer, each nozzle chamber comprising a floor having a chamber inlet defined therein; a roof comprising an actuator and part of the nozzle plate, the actuator being configured for ejecting ink through a nozzle opening defined in the roof; and silicon sidewalls extending from the floor to the roof;

drive circuitry laterally disposed relative to the nozzle chamber;

one or more connection arms extending parallel with the nozzle plate, each connection arm extending from the actuator towards the drive circuitry; and at least one metal via interconnecting each connection arm and the drive circuitry, each metal via extending perpendicularly to the nozzle plate, wherein the drive circuitry is positioned proximal the nozzle plate relative to a plane of the floor.

It will be appreciated that preferred embodiments of the first aspect are applicable mutatis mutandis to the second aspect.

Likewise, the substrate employed in the second aspect may be a silicon-on-insulator substrate having a first layer of silicon, an insulator layer disposed on the first layer of silicon and a second layer of silicon disposed on the insulator layer, wherein the nozzle chamber is defined in the second layer of silicon. In this preferred embodiment, the floor of each nozzle chamber preferably comprises part of the insulator layer.

As used herein, the term "ink" refers to any ejectable fluid and may include, for example, conventional CMYK inks, infrared inks, UV-curable inks, fixatives, 3D printing materials, polymers, biological fluids etc.

BRIEF DESCRIPTION OF THE DRAWINGS

Embodiments of the present invention will now be described by way of example only with reference to the accompanying drawings, in which:

FIG. 1 is a cutaway perspective view of part of a printhead integrated circuit comprising an inkjet nozzle device according to the present invention.

DETAILED DESCRIPTION OF THE INVENTION

Referring to FIG. 1, there is shown part of a printhead integrated circuit 10 ("printhead IC") according to the present invention comprising a plurality of inkjet nozzle devices 100 arranged in rows. Only one nozzle device 100 is shown in FIG. 1, although it will be appreciated that the printhead IC 10 may contain plurality of nozzle devices arranged in rows, as is well in known in the art.

The printhead IC 10 is based on a silicon-on-insulator wafer substrate comprising a first silicon layer 14, a second silicon layer 16 and an insulator layer 18, typically silicon oxide, sandwiched between the first and second silicon layers. As is typical in SOI wafers, the first silicon layer 14 is relatively much thicker than the second silicon layer 16. Typically, the second silicon layer 16 has a thickness in the range of 5 to 50 microns, the thickness being defined by the SOI wafer fabrication process. The first silicon layer 14 may have a thickness in the range of 100 to 1000 microns, the thickness usually being determined by an extent of backside grinding or etching as part of the printhead IC MEMS fabrication process.

A nozzle plate 20 is disposed on the second silicon layer 16. The nozzle plate 20 may be mono-layered, but more usually comprises a plurality of layers. As shown in FIG. 1, the nozzle plate comprises a tetraorthosilicate layer 22 deposited by plasma-enhanced chemical vapour deposition ("PETEOS layer"). The PETEOS layer 22 serves primarily as a passivating dielectric layer for insulating underlying CMOS drive circuitry 24. The nozzle plate further comprises a silicon nitride layer 26 disposed on the PETEOS layer 22, and a relatively thinner silicon oxide layer 28 disposed on the silicon nitride layer. The silicon nitride and oxide layers 26 and 28 define a ceramic roof for each nozzle chamber 30 of the inkjet nozzle device 100 as well defining a passive beam element for a thermal bend actuator. The combination of silicon nitride and silicon oxide layer advantageously minimizes cracking during fabrication and operation, and additionally maximizes thermal insulation of a thermoelastic beam element 32 disposed on the silicon oxide layer. These advantages are described in more detail in U.S. Pat. No. 8,079,668, the contents of which are herein incorporated by reference.

In the embodiment shown in FIG. 1, the nozzle plate further comprises an upper coating layer 34, which provides additional robustness and electrically insulates actuators from any adventitious conductive material (e.g. ink, fibres etc.) on the nozzle plate which may bridge between adjacent actuators and potentially cause shorting. The coating layer 34 may be comprised of a material, which provides surface characteristics optimized for printhead maintenance and fluidic management. Typically, a relatively hydrophobic coating layer 34 is preferred, such as a polymer, as described in U.S. Pat. No. 8,342,650, the contents of which are incorporated herein by reference.

Still referring to FIG. 1, each inkjet nozzle device 100 is embedded in the second silicon layer 16. The nozzle chamber 30 is defined in the second silicon layer 16 and comprises: a floor 35 comprising part of the insulator layer 18; a roof comprising part of the nozzle plate (layers 26, 28 and 34 as shown in FIG. 1); and sidewalls 37 extending between the floor and the roof, the sidewalls being silicon sidewalls defined by the second silicon layer 16. A chamber inlet 39 is defined in the floor 35, and a nozzle opening 41 is defined in the roof of the nozzle chamber 30. The nozzle opening 41 is typically offset from the chamber inlet 39.

Since the nozzle chamber 30 is defined by etching the second silicon layer 16, the height of the nozzle chamber generally corresponds to the height of the second silicon layer. Accordingly, relatively higher nozzle chambers may be provided by the present invention, which may not be feasible using the conventional MEMS deposition processes described in, for example, U.S. Pat. No. 7,819,503 and U.S. Pat. No. 6,755,509.

Suitable etch chemistries for selective frontside etching of the nozzle chamber 30 and chamber inlet 39 will be readily apparent to the person skilled in the art. The nozzle chamber 30 may be defined by DRIE of the second silicon layer 16 using, for example, a 'Bosch' etch (see U.S. Pat. No. 5,501,893) or other suitable etch chemistry (e.g. $SF_6/O_2/Ar$). The chamber inlet 39 may be selectively etched using any suitable oxide etch chemistry (e.g. $C_4F_8/O_2$).

The roof of the nozzle chamber 30 comprises an actuator for ejecting ink droplets through the nozzle opening 41 during use. In the embodiment shown in FIG. 1, the actuator is a thermal bend actuator comprising a thermoelastic beam element 32 and an underlying passive beam element comprised of the dual silicon nitride and silicon oxide layers 26 and 28. The roof comprises a moving portion 43 comprising the thermal bend actuator and a stationary portion 45. During actuation of the device, the thermoelastic beam element 32 receives an electrical pulse from the CMOS drive circuitry 24. The thermoelastic beam element 32 rapidly heats and expands relative to the underlying passive beam element, which causes bending of the moving portion 43 towards the floor 35 of the nozzle chamber 30, resulting in droplet ejection through the nozzle opening 41.

Roof-actuated thermal bend actuator devices have been described in detail in, for example, U.S. Pat. No. 7,794,056, the contents of which are incorporated herein by reference. Suitable materials for the thermoelastic beam element 32 include aluminium alloys, such as titanium-aluminium and vanadium-aluminium.

Suitable fabrication methods for forming the nozzle plate, including the roof of each nozzle chamber 30, are described in U.S. Pat. No. 7,866,795, the contents of which are incorporated herein by reference.

The CMOS drive circuitry 24, which provides current to the thermoelastic beam element 32, is laterally disposed relative to one sidewall 37 of the nozzle chamber 30. As shown in FIG. 1, the CMOS drive circuitry 24 comprises four metal layers, although it will be appreciated that any number of metal CMOS layers may be employed. The CMOS drive circuitry 24 is proximal the nozzle plate relative to the insulator layer 18 and the floor 35 of the nozzle chamber 30. Thus, the overall design of the inkjet nozzle device 100 minimizes the length of the current path between the drive circuitry 24 and the roof actuator, and makes the length of this current path independent of the height of the nozzle chamber 30 containing the roof actuator.

The thermoelastic beam element 32 is connected to the CMOS drive circuitry 24 via connection arms 46, each of which, in turn, is connected to an uppermost metal CMOS layer (M4) through copper vias 48. Each connection arm 46 (only one shown in FIG. 1) extends parallel with the nozzle plate from the thermoelastic beam element 32 towards the CMOS drive circuitry 24. Each connection arm 46 is coplanar and contiguous with the thermoelastic beam element 32, being comprised of the same material and deposited in one layer during MEMS fabrication. Suitable masking and etching of this layer defines the thermoelastic beam element 32 and contiguous connections arms 46 simultaneously in one fabrication step.

The copper vias 48 extend perpendicularly relative to the nozzle plate down to the uppermost CMOS layer. The copper vias are formed by first etching through the PETEOS layer 24, the silicon nitride layer 26 and the silicon oxide layer 28 to form vias, depositing a copper layer to fill the vias, and planarizing using, for example, chemical-mechanical-planarization (CMP) stopping on the silicon oxide layer 28. An analogous damascene-like process was described in U.S. Pat. No. 8,453,329, the contents of which are incorporated herein by reference.

The printhead IC 10 has at least one backside ink feed channel 50 defined in the first silicon layer 14. By analogy with the process described in Research Disclosure 596074, it will be appreciated that the insulator layer 18 provides an etch-stop for this backside etch.

In a monochrome printhead IC, all inkjet nozzle devices 100 may receive ink from a common backside ink feed channel 50 via respective chamber inlets 39 defined in the insulator layer 18. However, ink feed channel arrangements, such as those described in U.S. Pat. No. 7,441,865 (the contents of which are incorporate herein by reference) may, of course, be employed for multi-color printheads. Typically, one ink feed channel supplies ink to a pair of nozzle rows ("odd" and "even" nozzle rows) in a multi-color printhead.

Multiple printhead ICs 10 may be combined to form an inkjet printhead assembly, such as a pagewide inkjet printhead assembly. The printhead ICs 10 may be butted end-on-end as described in, for example, U.S. Pat. No. 7,441,865. Alternatively, the printhead ICs 10 may be combined in a staggered overlapping arrangement, as described in, for example, U.S. Pat. No. 6,394,573; U.S. Pat. No. 6,409,323 and U.S. Pat. No. 8,662,636, the contents of each of which are incorporated herein by reference. Accordingly, various types of inkjet printers employing the printhead ICs 10 will be readily apparent to the person skilled in the art.

It will, of course, be appreciated that the present invention has been described by way of example only and that modifications of detail may be made within the scope of the invention, which is defined in the accompanying claims.

The invention claimed is:

1. An inkjet printhead integrated circuit comprising:

a substrate having at least one silicon layer;

a nozzle plate disposed on the silicon layer; and one or more embedded inkjet nozzle devices, each inkjet nozzle device comprising:

a nozzle chamber defined in the silicon layer, each nozzle chamber comprising a floor having a chamber inlet defined therein; a roof comprising a thermal bend actuator, the thermal bend actuator having a thermoelastic material layer disposed on a passive layer and being configured for ejecting ink through a nozzle opening defined in the roof; and silicon sidewalls extending from the floor to the roof;

drive circuitry laterally disposed relative to the nozzle chamber;

one or more connection arms extending parallel with the nozzle plate, each connection arm comprising the thermoelastic material layer extending towards the drive circuitry; and at least one metal via interconnecting each connection arm and the drive circuitry, each metal via extending perpendicularly to the nozzle plate, wherein the drive circuitry is positioned relatively closer to the nozzle plate than to a plane of the floor.

2. The inkjet printhead integrated circuit of claim 1, wherein a height of the metal vias is less than a height of the nozzle chamber.

3. The inkjet printhead integrated circuit of claim 1, wherein the substrate is a silicon-on-insulator substrate having a first layer of silicon, an insulator layer disposed on the first layer of silicon and a second layer of silicon disposed on the insulator layer, and wherein the nozzle chamber is defined in the second layer of silicon.

4. The inkjet printhead integrated circuit of claim 3, wherein the floor of each nozzle chamber comprises part of the insulator layer.

5. The inkjet printhead integrated circuit of claim 3, wherein the first layer of silicon is relatively thicker than the second layer of silicon.

6. The inkjet printhead integrated circuit of claim 3, wherein a height of each nozzle chamber corresponds to a thickness of the second layer of silicon.

7. The inkjet printhead integrated circuit of claim 3, wherein at least one ink channel is defined in the first layer of silicon.

8. The inkjet printhead integrated circuit of claim 1, wherein the inkjet nozzle devices are arranged in rows, and wherein one or more rows of the inkjet nozzle devices receive ink from a common ink feed channel via respective chamber inlets.

9. The inkjet printhead integrated circuit of claim 1, wherein the nozzle plate comprises a plurality of layers.

* * * * *